US008056258B2

(12) United States Patent
Suda et al.

(10) Patent No.: US 8,056,258 B2
(45) Date of Patent: Nov. 15, 2011

(54) CORD DRYING METHOD AND CORD DRYING APPARATUS FOR CARRYING OUT THE SAME

(75) Inventors: Nobuyuki Suda, Kodaira (JP); Kiyotaka Yoshi, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 918 days.

(21) Appl. No.: 11/996,412

(22) PCT Filed: Jul. 25, 2006

(86) PCT No.: PCT/JP2006/314603

§ 371 (c)(1),
(2), (4) Date: Mar. 11, 2008

(87) PCT Pub. No.: WO2007/013416

PCT Pub. Date: Feb. 1, 2007

(65) Prior Publication Data

US 2009/0142497 A1 Jun. 4, 2009

(30) Foreign Application Priority Data

Jul. 25, 2005 (JP) ..... 2005-214908

(51) Int. Cl.
*F26B 5/04* (2006.01)

(52) U.S. Cl. ..... 34/413; 34/497; 34/144; 34/90; 34/519; 118/68; 118/207; 427/372.2

(58) Field of Classification Search ..... 34/397, 34/413, 497, 144, 90, 100, 519, 86; 427/372.2; 118/68, 207
See application file for complete search history.

(56) References Cited

U.S. PATENT DOCUMENTS

| | | | | | |
|---|---|---|---|---|---|
| 1,509,365 | A * | 9/1924 | Midgley | 156/179 |
| 2,276,395 | A * | 3/1942 | Hill et al. | 264/40.1 |
| 3,129,129 | A * | 4/1964 | Schrode et al. | 156/161 |
| 3,157,545 | A * | 11/1964 | Waldron et al. | 156/184 |
| 3,224,922 | A * | 12/1965 | Fry, Jr. | 156/433 |
| 5,277,928 | A * | 1/1994 | Strandberg | 427/10 |
| 5,355,820 | A * | 10/1994 | Conrad et al. | 114/102.31 |
| 7,779,882 | B2 * | 8/2010 | Takagi et al. | 156/427 |
| 2004/0132369 | A1 * | 7/2004 | Head et al. | 442/269 |
| 2006/0174998 | A1 * | 8/2006 | Takagi et al. | 156/166 |
| 2008/0190549 | A1 * | 8/2008 | Takagi et al. | 156/117 |
| 2009/0142497 | A1 * | 6/2009 | Suda et al. | 427/372.2 |

FOREIGN PATENT DOCUMENTS

| | | | |
|---|---|---|---|
| DE | 19836773 | A1 * | 2/2000 |
| DE | 19858152 | A1 * | 6/2000 |
| JP | 57084571 | A * | 5/1982 |

(Continued)

*Primary Examiner* — Stephen M. Gravini
(74) *Attorney, Agent, or Firm* — Sughrue Mion, PLLC

(57) ABSTRACT

A cord drying apparatus dries cords for forming cord-inserted bands, such as belts and components of tires, such as carcasses. A plurality of cords C unwound from a plurality of reels 1*a* held in a wheeled creel 1 are passed through guide holes formed in a guide plate 21 and are extended to an insulation head 6. Vertically movable rollers 4 are moved down from their home positions above the cords C to cause the cords C to extend along curved heating surfaces of heating boards 5. The cords C are moved along the heating surfaces of the heating boards 5 to dry the cords C. The cords C can be easily extended along and pressed against the heating surfaces of the heating boards 5. Thus cords C can be changed in a short time and the efficiency of operations for drying cords C by a drying process can be improved.

8 Claims, 7 Drawing Sheets

FOREIGN PATENT DOCUMENTS

| | | | | |
|---|---|---|---|---|
| JP | 62139253 | A | * | 6/1987 |
| JP | 62140824 | A | * | 6/1987 |
| JP | 62165861 | A | * | 7/1987 |
| JP | 9-41238 | A | | 2/1997 |
| JP | 2001-336078 | A | | 12/2001 |
| JP | 2005-13968 | A | | 1/2005 |

* cited by examiner

CORD DRYING METHOD AND CORD DRYING APPARATUS FOR CARRYING OUT THE SAME

FIELD OF THE INVENTION

The present invention relates to a drying technique for drying cords and, more specifically, to a drying technique for drying highly hygroscopic cords for forming components of tires, such as rayon cords or nylon cords.

BACKGROUND ART

A plurality of cords for tires, particularly, cords for forming carcasses of tires are extended parallel to each other and the parallel cords are covered with rubber to form a rubber-covered flat cord. Cord processing methods and cord processing apparatuses for forming such a rubber-covered flat cord are known (see, for example, Patent Document 1).

Polyester and nylon cords are used generally for forming carcasses of tires. Rayon cords excellent in heat resistance and fatigue resistance are used prevalently for forming carcasses of radial tires for passenger cars. Rayon cords, however, are highly hygroscopic and the strength thereof decreases when they absorb moisture. Therefore, rayon cords for forming carcasses need to be dried by a drying process before being covered with rubber by a coating process.

A cord drying apparatus of a cord covering apparatus for covering cords for forming carcasses with rubber has been used for drying cords. In this cord drying apparatus, a plurality of cords pulled out from reels held in a wheeled creel are passed through a guide plate to extend the cords parallel to each other. The parallel cords are wound round hot-water-heated, rotary drying drums disposed at plurality of drying stages to dry the cords.

JP 2001-336078 A (P. 1, FIG. 33)

DISCLOSURE OF THE INVENTION

Underlying Problem to be Solved

The known cord covering apparatus described above is an apparatus for covering cords with rubber which are used to produce carcasses. Referring to FIG. 9, the cord covering apparatus has a cord drying apparatus for drying cords 0C. Reels 01*a* storing cords CC are mounted on a wheeled creel 03. The cords 0C unwound from the reels 01*a* are passed through a main guide plate 021 and parallelizing rollers 022 to arrange the cords 0C parallel to each other in the shape of a band of the cords 0C. The band of the cords 0C is guide by guide rollers 03 to a cord drying apparatus including a plurality of hot-water-heated, rotary drying drums 05 arranged at a plurality of drying stages. The band of the cords CC is passed in a zig zag fashion round the drying drums 05 successively to dry the cords 0C.

This cord drying apparatus of the cord covering apparatus is provided with the plurality of hot-water-heated, drying drums which are heated at desired temperatures, respectively and arranged at a plurality of stages, and the cords are passed in zig zag fashion round the plurality of drying drums at a plurality of stages. For this reason, cord passing work for passing the cords round the drying drums takes time and is considerably troublesome.

After all the cords on the wheeled creel have been processed, the empty wheeled creel is replaced with a fully loaded wheeled creel. When the empty wheeled creel is replaced with the fully loaded wheeled creel, a plurality of cords pulled out from the fully loaded wheeled creel need to be newly passed round the drying drums. As mentioned above, the cord passing work for passing the cords round the drying drums is troublesome and takes as long as one hour. The troublesome cord passing work for passing cords round the drying drums needs to be performed every time the wheeled creels are changed. Thus changing wheeled creels waste much time.

If even one cord among 100 cords being processed by the cord drying process breaks during the cord drying process, the 99 cords are wound round the rotating drying drums. Therefore, the broken cord is continuously pulled out from the wheeled creel and, eventually, the broken cord is entangled. Consequently, a cord processing operation for processing the cords is interrupted. Repairing work for piecing together broken ends of a broken cord takes even about one hour. Since the drying drums are heated by hot water it takes as long as about two hours to heat the drying drums at the desired temperatures after the completion of the repairing work. If a hot water boiler of a large capacity is used to cope with such a problem, the cost of the cord processing apparatus and floor space needed by the cord processing apparatus increase.

The present invention has been made in view of the foregoing problems and it is therefore an object of the present invention to provide a cord drying method capable of accomplishing cord passing work for extending a plurality of cords in a short time when wheeled creels are changed, of heating the heating means of a cord drying apparatus at a desired temperature in a short time, of facilitating repairing work for piecing together broken ends of cords broken during a drying process and of being carried out by a cord drying apparatus of comparatively simple construction, and suitable particularly for drying rayon cords. A further object of the present invention is to provide a cord drying apparatus for carrying out the cord drying method.

Means for Solving the Underlying Problem

To solve the foregoing problems, the present invention provides a cord drying method used in a process of processing cords for forming a component member of a tire by passing cords pulled out from a wheeled creel through a guide plate to extend the cords parallel to each other, delivering the parallel cords to an insulation head, and processing the parallel cords by a covering process by the insulation head to coat the parallel cords with rubber, the cord drying method comprising the steps of: lowering upper rollers disposed above the parallel cords passed through the guide plate and extended directly to the insulation head; pressing the parallel cords by the upper rollers so as to extend along heating surfaces of heating boards by lowering the upper rollers; and drying the cords by pressing the cords against the heating surfaces of the heating boards.

The cords are supported by lower guide rollers disposed under the cords when the cords are pressed against the heating surfaces of the heating boards by lowering the upper rollers.

Typically, the cords are those for forming a component member of a tire. More concretely, the cords are hygroscopic rayon or hygroscopic nylon cords.

According to another aspect of the present invention, there is provided a cord drying apparatus comprising: a wheeled creel supporting a plurality of reels storing cords; a guide plate for regularly arranging the cords unwound from the reels so as to extend parallel to each other and guiding the regularly arranged cords toward an insulation head; guide rollers for guiding the cords; heating boards disposed between the guide rollers and the insulation head and selectively used to dry the parallel cords or not to dry the parallel cords; and vertically movable rollers movable down from a position above the heating boards to a position below the heating boards to press the cords so as to extend along surfaces of the heating boards to dry the cords by a drying process.

Preferably, each of the heating boards has a heating plate having a substantially vertically extending curved heating surface, and is internally provided with a heater.

Typically, the heating boards includes a stationary middle heating board, and movable heating boards disposed on the opposite sides, respectively, of the middle heating board.

EFFECT OF THE INVENTION

The cord drying method of the present invention processes the cords by a drying process by pressing down the parallel cords parallelized by the guide plate to press the cords against the heating surfaces of the heating boards by moving down the upper rollers. Thus, the cords are not passed round any drying drums. Therefore the preparations for processing the cords by a drying process can be accomplished in a short time, the wheeled creels can be smoothly changed in a short time, and the facility of the cord drying work can be improved remarkably.

Since the cords are not wound round rotating drying drums, repairing work for piecing together broken ends of a broken cord does not need to pass the cord round drying drums and hence repairing work can be accomplished in a short time. Since the broken cord will not be entangled, the broken cord may be left unrepaired, repairing time for piecing together broken ends of the broken cord can be omitted, and the broken cord can be easily repaired.

The cords can be used for forming a component member of a tire, even if the cords are highly hygroscopic.

Highly hygroscopic rayon and nylon cords can be effectively dried by the drying process and hence the cords have excellent qualities essential to cords for forming carcasses.

The cord drying apparatus of the present invention is provided with the vertically movable rollers for pressing down the cords and pressing the cords against the heating surfaces of the heating boards. Therefore, the cords can be subjected to the drying process simply by moving down the vertically movable rollers. Thus the cords are pressed down and are pressed against the heating surfaces of the heating boards by moving down the vertically movable rollers. Thus preparations for processing the cords by a drying process can be accomplished in a very short time.

When the cords are not processed by the drying apparatus, the vertically movable rollers can be easily moved to the upper positions. Since the cords are pressed against the heating surfaces of the heating boards, troublesome work such as needed for passing the cords round a plurality of drying drums arranged at stages is not necessary. Since the cords are not wound round rotary drying drums, a broken cord is rarely entangled, and the broken cord can be repaired in a short time.

When each of the heating boards is provided with the heating plates each having the substantially vertically extending curved heating surface, and the heater, the curved heating surfaces for heating the cords for the drying process can be heated at a desired temperature in a short heating time, the preparations for processing the cords by the drying process can be accomplished quickly, and the efficiency of the drying process can be remarkably improved.

The curved surfaces of the heating plates of the heating boards have an excellent guiding effect on guiding the cords. Since the cords move smoothly along the curved heating surfaces and are pressed against the curved heating surfaces at a proper contact pressure, the cords can be very effectively dried. The cords are rarely broken and can be very effectively dried. Since an electric heater is used as the heater, the heating device is comparatively simple in construction, easy to handle and excellent in heating effect.

When the heating boards are made up of the stationary middle heating board, and the movable heating boards disposed on the opposite sides, respectively, of the middle heating board, the cords can be easily and properly pressed against the heating surfaces of the heating boards by the vertically movable rollers.

The cords can be passed along a zigzag path so as to extend along the heating surfaces of the heating boards by moving the vertically movable rollers through spaces each between adjacent ones of the lower rollers disposed between the guide plate and the insulation head to support the cords.

REFERENCE CHARACTERS

1 . . . Wheeled creel, 1*a* . . . Reel, 2 . . . Cord parallelizing unit, 21 . . . Main guide plate, 22 . . . Parallelizing guide rollers, 3, 31, 32 and 33 . . . Guide rollers, 4, 41 and 42 . . . Vertically movable rollers, 5, 51, 52 and 53 . . . Heating boards, 51*a*, 52*a* and 53*a* . . . Curved heating surfaces, 6 . . . Insulation head, 7 . . . Take-up unit, C . . . Cord, C1 . . . Cord-inserted rubber band

BEST MODE FOR CARRYING OUT THE INVENTION

A cord drying apparatus in a preferred embodiment of the present invention will be described with reference to FIGS. 1 to 8.

Figure 1:
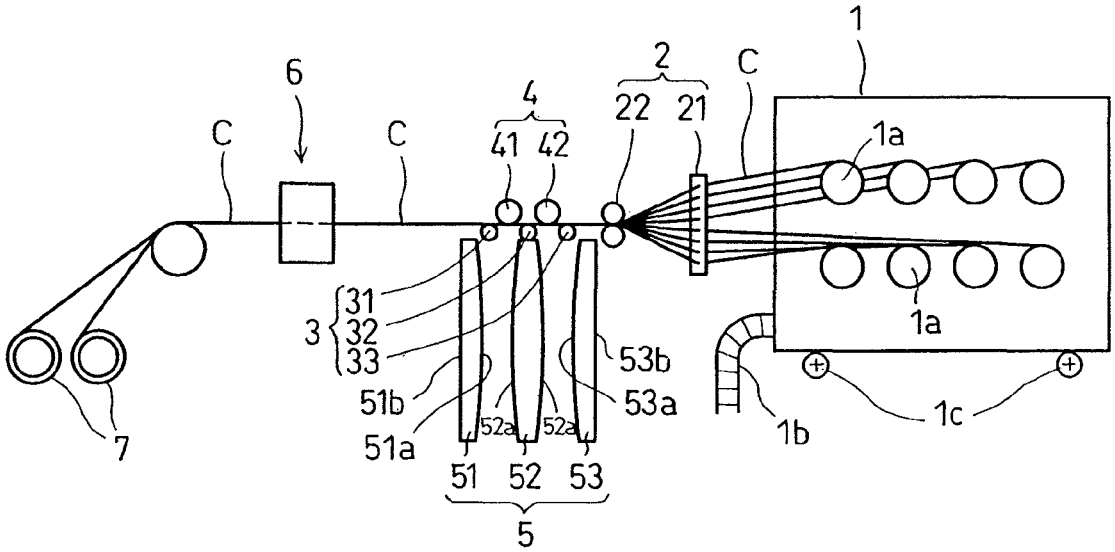
FIG. 1 is a schematic side elevation of a system including a cord drying apparatus in a preferred embodiment of the present invention, which is not in a cord drying operation.
Figure 3:
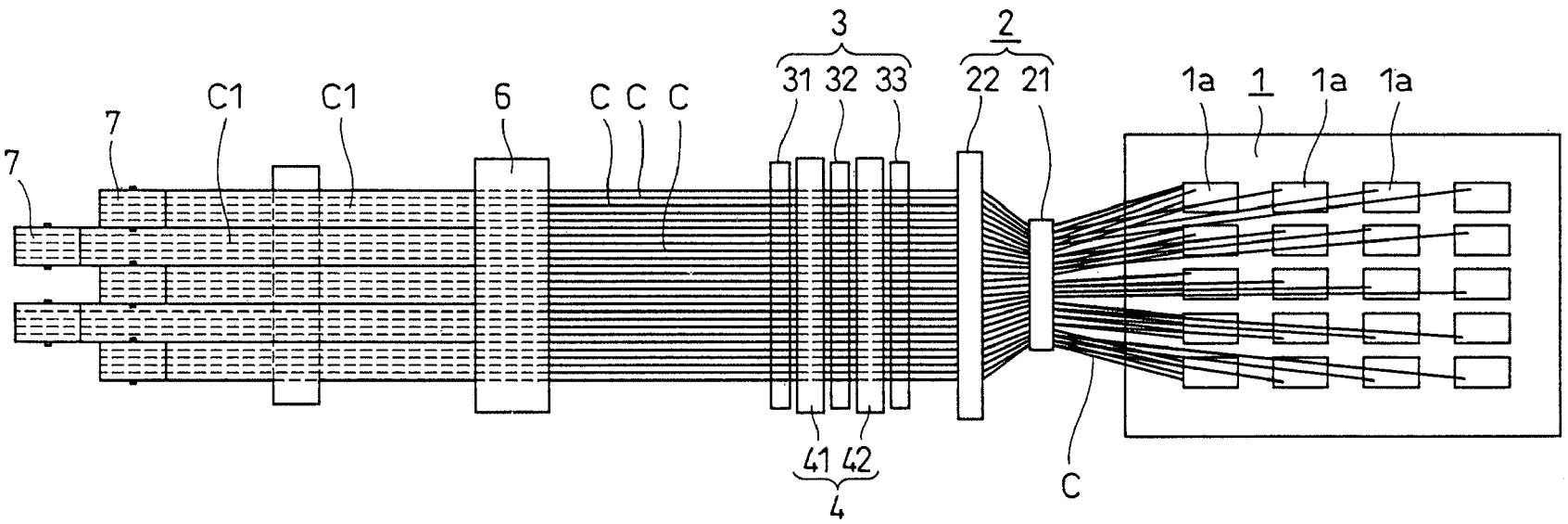
FIG. 3 is a top view of the system including the cord drying apparatus in the preferred embodiment in the cord drying operation.

FIGS. 1 and 3 show a rubber band forming system including the cord drying apparatus in the preferred embodiment. The cord drying apparatus is applicable to drying rayon and nylon cords.

The cord drying apparatus will be described as applied to a rubber band forming system to dry rayon cords C for forming carcasses. The rubber band forming system includes a wheeled creel 1 holding a plurality of reels 1*a* each storing a rayon cord C, a cord parallelizing unit 2 for parallelizing the rayon cords C unwound from the reels 1*a*, guide rollers 3 for supporting and guiding the parallel rayon cords C supplied from the cord parallelizing unit 2, an insulation head (INS head) 6 for coating the parallel rayon cords C with rubber to produce cord-inserted rubber bands, heating boards 5 disposed below the guide rollers 3, and vertically movable rollers 4. The vertically movable rollers 4 are disposed on the upper side of the parallel rayon cords C in contact with the rayon cords C while the cord drying apparatus is not in operation. The vertically movable rollers 4 are moved down to press the parallel rayon cords C so that the rayon cords C are brought into close contact with the heating boards 5.

The wheeled creel 1 has an external shape substantially resembling a box. The wheeled creel 1 has a sealed internal space. An air conditioning duct 1*b* is connected to the wheeled creel 1 to control the moisture content of the sealed internal space of the wheeled creel 1. A plurality of the reels 1*a* storing the rayon cords C are held in the wheeled creel 1. The reels 1*a* are held in a position and attitude facilitating smooth sending out of the rayon cords C toward the guide plate 21 of the cord parallelizing unit 2. The number of the reels 1*a* held in the wheeled creel 1 is several tens. The maximum number of the reels 1*a* that can be held in the wheeled creel 1 is one hundred. The length of the rayon cord C wound on each reel 1*a* is about 8000 m.

The wheeled creel 1 is provided with wheels 1*c* and movable. A proper number of the wheeled creels 1 are prepared. Reserve wheeled creels 1 each holding a plurality of full reels 1*a* fully loaded with rayon cords C are prepared for replacement. When the reels 1*a* of a wheeled creel 1 become empty, the wheeled creel 1 holding the empty reels 1*a* is replaced with another wheeled creel 1 holding full reels 1*a*.

The rayon cords C unwound from the reels 1*a* held in the wheeled creel 1 are pulled when take-up units 7 take up cord-inserted rubber bands. Suitable braking force is applied to the reels 1*a* to prevent the rayon cords C being processed from slackening and to apply a predetermined tension to the rayon cords C.

Figure 4:
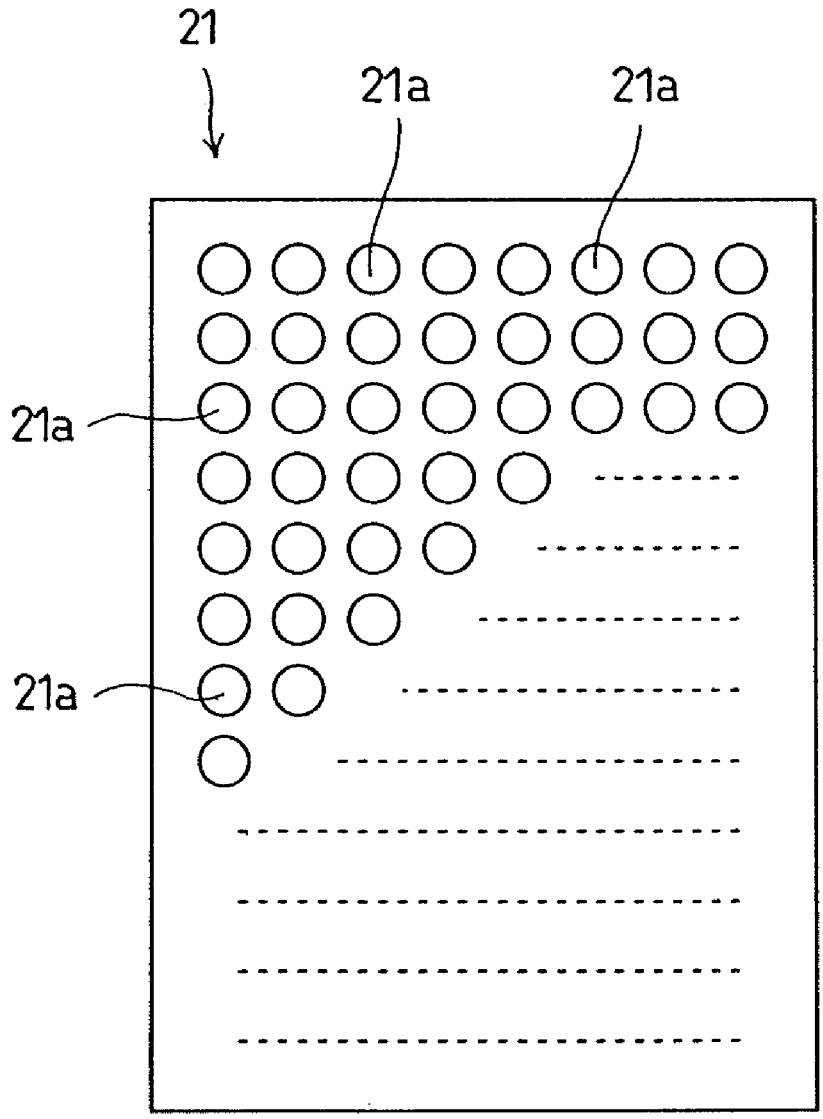
FIG. 4 is a front elevation of a main guide plate included in the cord drying apparatus in the preferred embodiment.

The rayon cords C unwound from the reels 1*a* held in the wheeled creel 1 are passed through small guide holes 21*a* formed in the guide plate 21 shown in FIG. 4. The main guide plate 21 has a substantially rectangular shape and a predetermined thickness. The small guide holes 21*a* are accurately arranged in columns and rows. The rayon cords C delivered from the reels 1*a* held in the wheeled creel 1 are passed individually through the guide holes 21*a*, respectively.

The number of the small guide holes 21*a* of the main guide plate 21 is equal to or somewhat greater than that of the reels 1*a* held in the wheeled creel 1 to cope with changes in the number of the reels 1*a* held in the wheeled creel 1 in a narrow range. The rayon cords C individually passed through the small guide holes 21*a* of the main guide plate 21 run between the parallelizing guide rollers 22.

The parallelizing guide rollers 22 parallelizes the rayon cords C so as to extend parallel to each other at substantially equal intervals to form bands of the parallel rayon cords C. The bands of the parallel rayon cords C runs directly to the insulation head (INS head) 6 as shown in FIG. 1 when the rayon cords C are not dried by a drying process. In this state, the guide rollers 3 and the vertically movable rollers 4 are in contact with the lower and the upper surface, respectively, of the bands of the parallel rayon cords C, and the rollers 3 and 4 are positioned adjacent to the parallelizing guide rollers 22.

As shown in FIG. 1, the guide rollers 3 and the vertically movable rollers 4 are on the opposite sides, respectively, of the bands of the parallel rayon cords C. The vertically movable rollers 4 are held at their upper positions on the upper side of the bands of the parallel rayon cords C when the drying process is not executed. The vertically movable rollers 4 are moved vertically down to their lower positions when the drying process is executed as will be described hereinafter.

The three guide rollers 3, namely, the three guide rollers 31, 32 and 33, have the same diameter and the same length. The guide rollers 31, 32 and 33 are arranged at equal intervals in a direction in which the rayon cords C run. The intervals between the guide rollers 31, 32 and 33 are dependent on the positions of the heating boards 5, the interval between the two vertically movable rollers 41 and 42, and the diameter of the vertically movable rollers 41 and 42.

Figure 5:
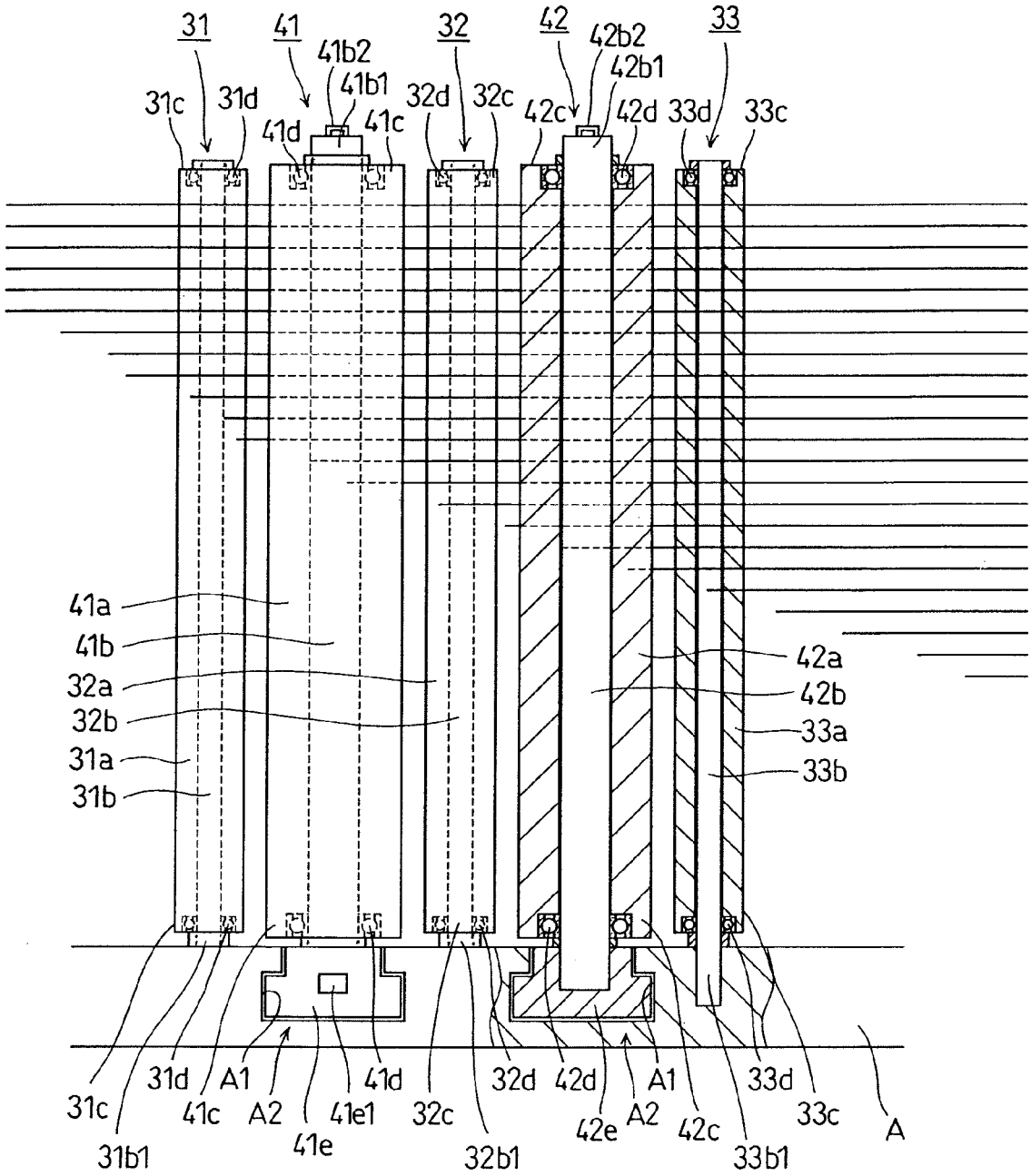
FIG. 5 is a top view of a principal mechanism of the cord drying apparatus in the preferred embodiment.

As will be seen from FIG. 5, the three guide rollers 31, 32 and 33 have hollow cylinders 31*a*, 32*a* and 33*a*, and shafts 31*b*, 32*b* and 33*b* rotatably supporting the hollow cylinders 31*a*, 32*a* and 33*a*, respectively. The shafts 31*b*, 32*b* and 33*b* have ends 31*b*1, 32*b*1 and 33*b*1 fixedly held in a cantilever fashion on a side frame A of the cord drying apparatus so as to extend across the working area of the cord drying apparatus. The hollow cylinders 31*a*, 32*a* and 33*a* are put on the shafts 31*b*, 32*b* and 33*b*, respectively. Longitudinally opposite ends 31*c*, 32*c* and 33*c* of the hollow cylinders 31, 32 and 33 are supported for rotation by ball bearings 31*d*, 32*d* and 33*d* on the shaft 31*b*, 32*b* and 33*b*, respectively.

The guide rollers 31, 32 and 33 function as guide means for the rayon cords C to be lowered along the heating boards 5 and to be brought into close contact with the heating boards 5, when the vertically movable rollers 41 and 42 located above the guide rollers 31, 32 and 33 are moved down during the drying process for drying the rayon cords C.

The vertically movable rollers 41 and 42, namely, the two vertically movable rollers 4, have a diameter greater than that of the guide rollers 31, 32 and 33, and a length substantially equal to that of the guide rollers 31, 32 and 33.

The vertically movable rollers 41 and 42 have hollow cylinders 41*a* and 42*a*, and shafts 41*b* and 42*b* rotatably supporting the hollow cylinders 41*a* and 42*a*, respectively. The shafts 41*b* and 42*b* have ends fixedly held on sliding blocks 41*e* and 42*e* and are supported in a cantilever fashion on the sliding blocks 41*e* and 42*e*, respectively, so as to extend across the working area of the cord drying apparatus. The hollow cylinders 41*a* and 42*a* are put on the shafts 41*b* and 42*b*, respectively. Longitudinally opposite ends 41*c* and 42*c* of the hollow cylinders 41*a* and 42*a* are supported for rotation by ball bearings 41*d* and 42*d* on the shaft 41*b* and 42*b*, respectively. The sliding blocks 41*e* and 43*e* slide vertically in guide grooves A1 formed in guide parts A2 of the side frame A of the drying apparatus to move the vertically movable rollers 41 and 42 vertically.

The two vertically movable rollers 41 and 42 are moved up by hand. When necessary, the sliding blocks 43*e* and 42*e* are moved up along the guide grooves A1 to move the vertically movable rollers 41 and 42 up by pulling up strings or thin wires, not shown, connected to hooks 41*e*1 and 42*e*1 attached to upper parts of the sliding blocks 41*e* and 42*e* and to hooks 41*b*2 and 42*b*2 attached to the outer ends 41*b*1 and 42*b*1 of the cantilever shafts 41*b* and 42*b*, respectively. The two vertically movable rollers 41 and 42 can be moved down by controlling the delivery of the rayon cords C from the wheeled creel 1.

The sliding blocks 41*e* and 42*e* are allowed to move down when the rayon cords C are delivered from the wheeled creel 1.

In FIG. 1, the two vertically movable rollers 41 and 42 are held at their upper position at a level above that of the guide rollers 31, 32 and 33 so as to be in contact with the upper surface of the bands of the parallel rayon cords C. The upper positions of the vertically movable rollers 4, namely, the vertically movable rollers 41 and 42, are home positions where the vertically movable rollers 41 and 42 are held while the drying process for drying the rayon cords C is not executed; that is, the upper positions are vertically movable roller holding positions where the vertically movable rollers 41 and 42 are held inoperative or the initial positions of the vertically movable rollers 41 and 42.

The respective home positions of the two vertically movable rollers 41 and 42 are directly above the middle point of a space between the lower guide rollers 31 and 32, and the middle point of a space between the lower guide rollers 32 and 33, respectively. The vertically movable rollers 41 and 42 are held rotatably at their home positions by fixedly retaining the sliding blocks 41*e* and 42*e* respectively fixedly connected to the ends 41*c* and 42*c* of the vertically movable rollers 41 and 42 at upper positions in the guide grooves A1 of the guide parts A2, respectively, by retaining mechanisms, not shown. The retaining mechanisms are generally known ones.

Figure 2:
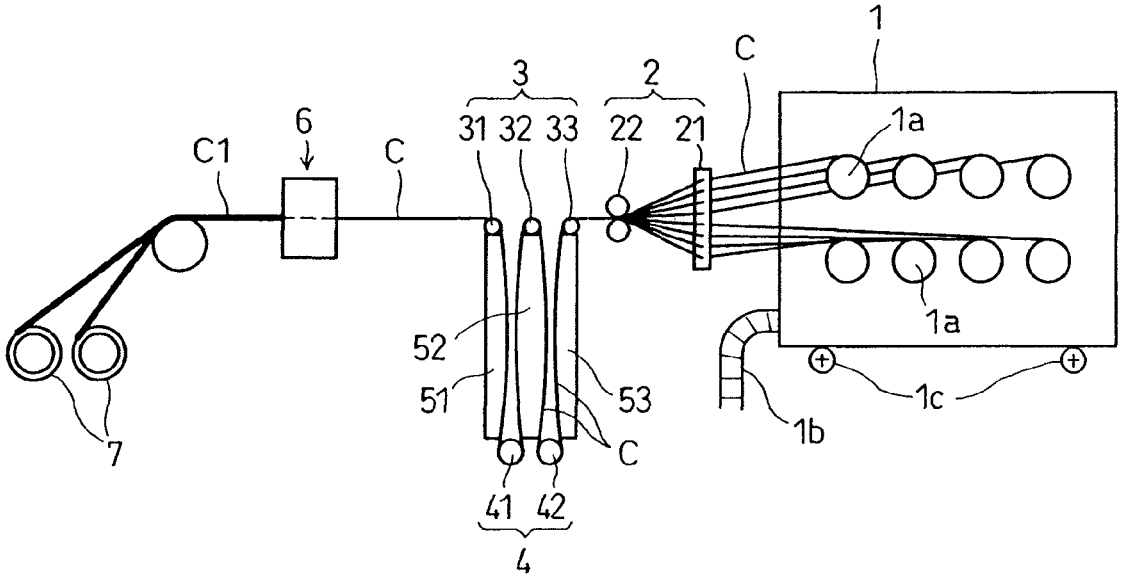
FIG. 2 is a schematic side elevation of the system including the cord drying apparatus in the preferred embodiment in a cord drying operation.

When the drying process is executed, the two sliding blocks 41*e* and 42*e* are released so as to be slide along the guide grooves A1 of the guide parts A2. Then, the ends 41*c* and 42*c* of the vertically movable rollers 41 and 42 move down along the guide grooves A1 as shown in FIG. 2 as the rayon cords C are sent out from the wheeled creel 1. The bands of the rayon cords C can be extended along and pressed against the heating surfaces of the heating boards 5 as the vertically movable rollers 41 and 42 move down vertically.

The two vertically movable rollers 41 and 42 are pulled up by hand when the rayon cords C are not dried. Then, the sliding block 41*e* and 42*e* connected to the ends 41*c* and 42*c* slide up along the guide grooves A1 of the guide parts A2. Thus the vertically movable rollers 41 and 42 are returned to and held at their home positions as shown in FIG. 1.

The vertically movable rollers 41 and 42 move along the space between the lower guide rollers 31 and 32, and the space between the lower guide rollers 32 and 33, respectively, when the vertically movable rollers 41 and 42 are moved down and are moved up to their home positions. The space between the lower guide rollers 31 and 32, and the space between the lower guide rollers 32 and 33 are formed in a width sufficient to facilitate the vertical movement of the vertically movable rollers 41 and 42 along the spaces as shown in FIG. 5. The respective numbers, diameters, lengths and spaces between adjacent ones of the lower guide rollers 3 and the vertically movable rollers 4, namely, the vertically movable rollers 41 and 42, are selectively and properly determined taking into consideration the number of the heating boards 5.

The three heating boards 5, namely, the heating boards 51, 52 and 53, are disposed below the three lower guide rollers 31, 32 and 33. The heating boards 51, 52 and 53 are arranged at equal intervals. The middle heating board 52 is fixedly disposed directly below the middle lower guide roller 32 among the three guide rollers 31, 32 and 33 as shown in FIG. 1.

Each of the left heating board 51 and the right heating board 53 is movable between an outer position shown in FIG. 1 and an inner position shown in FIG. 2. When the left heating board 51 is at the outer position, the left lower guide roller 31 is at a position corresponding to the middle point of the space between the left heating board 51 and the middle heating board 52. When the left heating board 51 is at the inner position, the left heating board 51 is below the left lower guide roller 31. When the right heating board 53 is at the outer position, the right lower guide roller 33 is at a position corresponding to the middle point of the space between the right heating board 53 and the middle heating board 52. When the right heating board 53 is at the inner position, the right heating board 53 is below the right lower guide roller 33.

The left heating board 51 and the right heating board 53 are disposed at their outer positions, respectively, as shown in FIG. 1 when the rayon cords C are not processed by the heating device. The left heating board 51 and the right heating board 53 are disposed at their inner positions, respectively, as shown in FIG. 2 when the rayon cords C are processed by the heating device.

The left heating board 51 and the right heating board 53 are moved to their inner positions, respectively, after the two vertically movable rollers 41 and 42 have been moved to their lower positions, respectively, to execute the drying process for drying the rayon cords C.

All the parallel rayon cords C arranged in the bands are extended between the left heating board 51 and the middle heating board 52 and between the middle heating board 52 and the right heating board 53 as the vertically movable rollers 41 and 42 are moved down. Then, the left heating board 51 and the right heating board 53 are moved to their inner positions, respectively. Consequently, the parallel rayon cords C are pressed against the curved heating surfaces 51*a*, 52*a* and 53*a* of the heating boards 51, 52 and 53 (see FIG. 6. and also FIG. 1).

Description of a method of moving the left heating board 51 and the right heating board 53 toward and away from the middle heating board 52 will be omitted. The left heating board 51 and the right heating board 53 may be moved manually or may be moved mechanically using a moving device including a screw feed device or the like and guide members; that is, the left heating board 51 and the right heating board 53 may be moved by generally known moving means.

Figure 6:
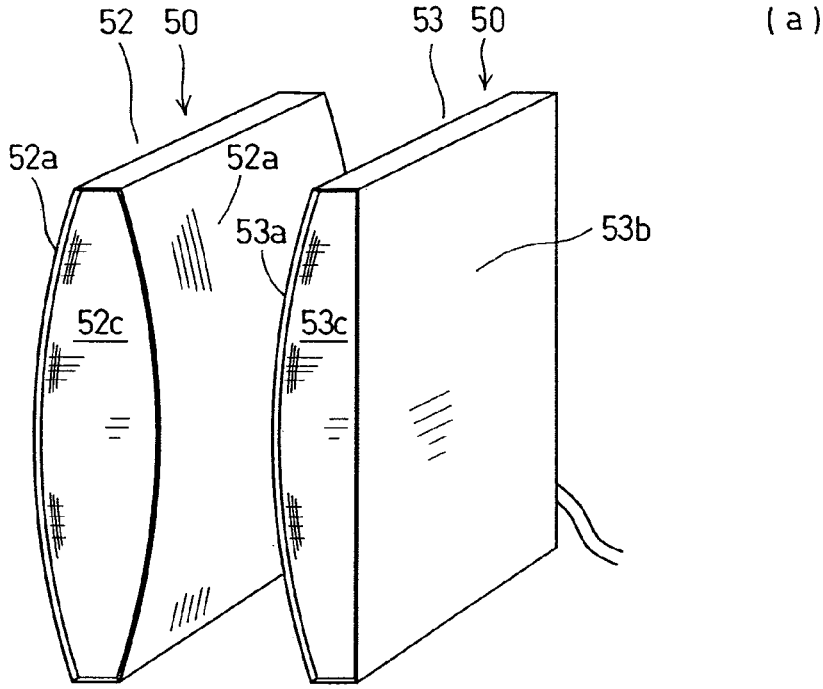
FIG. 6 shows perspective views of heating boards included in the cord drying apparatus in the preferred embodiment and a heating board in a modification, respectively.
Figure 6:
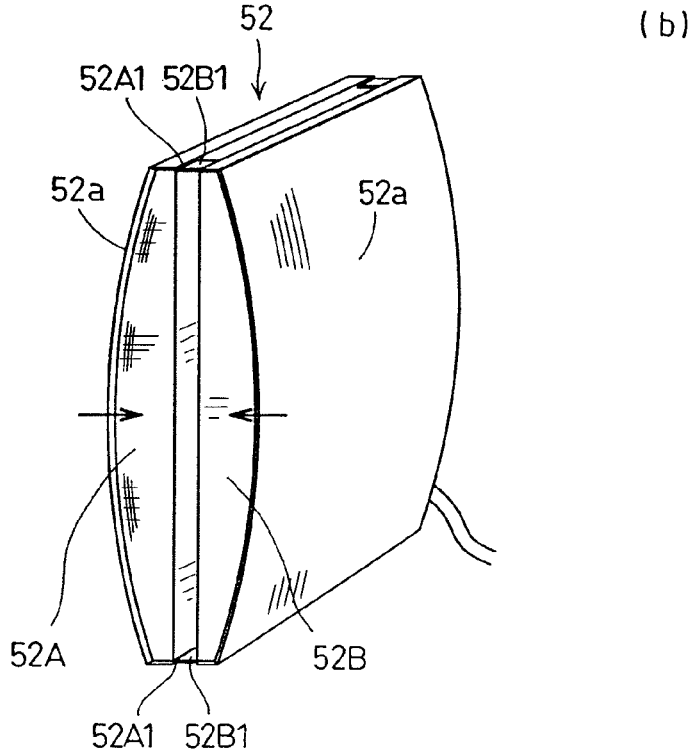

As shown in a perspective view in FIG. 6(*a*), in which the left heating board 51 is omitted, each of the heating boards 51, 52 and 53 has a body 50 substantially rectangular in a plane. The left heating board 51 has the gently curved heating surface 51*a* facing the middle heating board 52 and a flat surface facing away from the middle heating board 52, the middle heating board 52 has the opposite, gently curved heating surfaces 52*a*, and the right heating board 53 has the gently curved heating surface 53*a* facing the middle heating board 52 and a flat surface 53*b* (see also FIG. 1) facing away from the middle heating board 52.

The heating boards 51, 52 and 53 each having the body 50 are electric heating boards. The heating surfaces of the heating boards 5 need to be maintained at about 105° C. Therefore, each of the heating boards 5 is provided with an electric heater having a heating capacity sufficient to maintain the heating surface at about 105° C. The body 50 of the middle heating board 52 is formed by disposing two curved metal plates having the curved heating surfaces 52*a* opposite to each other and attaching side plates 52*c* to the side edges of the two metal plates, respectively. The electric heater is disposed inside the body 50.

The body 50 of the heating boards 51 is formed by disposing a curved plate having the heating surface 51*a* and a flat plate having the flat surface 51*b* opposite to each other and attaching side plates 51*c* to the side edges of the curved plate and the flat plate. The body 50 of the heating boards 53 is formed by disposing a curved plate having the heating surface

53*a* and a flat plate having the flat surface 53*b* opposite to each other and attaching side plates 53*c* to the side edges of the curved plate and the flat plate. The heating boards 51 and 53 are internally provided with the electric heaters, respectively. The height, namely, the length in a vertical direction, of the body 50 of each of the heating boards 51, 52 and 53 is about 1300 mm.

The rayon cords C are pressed against the curved heating surfaces 51*a*, 52*a* and 53*a* of the heating boards 51, 52 and 53 by moving down the vertically movable rollers 41 and 42. The left heating board 51 and the right heating board 53 are held at their outer positions, respectively, and the middle heating board 52 is fixed in place during the downward movement of the vertically movable rollers 41 and 42. Therefore, it is possible that the vertically movable rollers 41 and 42 come into contact with the curved heating surfaces 52*a* of the middle heating board 52, respectively, during downward movement. Consequently, the rayon cords C might be caught between the vertically movable roller 41 and the curved heating surface 52*a* and between the vertically movable roller 42 and the curved heating surface 52*a*, the rayon cords C might be damaged or broken, and the downward movable rollers 41 and 42 might not be able to move down smoothly.

To avoid such trouble, the middle heating board 52 is formed by combining two separate, divisional heating boards 52A and 52B having curved outer surfaces serving as the curved heating surfaces 52*a* as shown in FIG. 6(*b*). The divisional heating boards 52A and 52B are moved away from each other to press the curved heating surfaces 52*a* against the rayon cords C during the drying process.

The two divisional heating boards 52A and 52B are moved toward each other and are joined together to retract the curved heating surfaces 52*a* from their working positions when the drying process is not executed to avoid the contact between each of the vertically movable rollers 41 and 42 and the corresponding curved heating surface 52*a* during the downward movement of the vertically movable rollers 41 and 42. The divisional heating boards 52A and 52B are provided at their upper and lower ends with nesting joining parts 52A1 and 52B1. The divisional heating boards 52A and 52B are manually moved toward and away from each other by using a screw mechanism.

Figure 7:
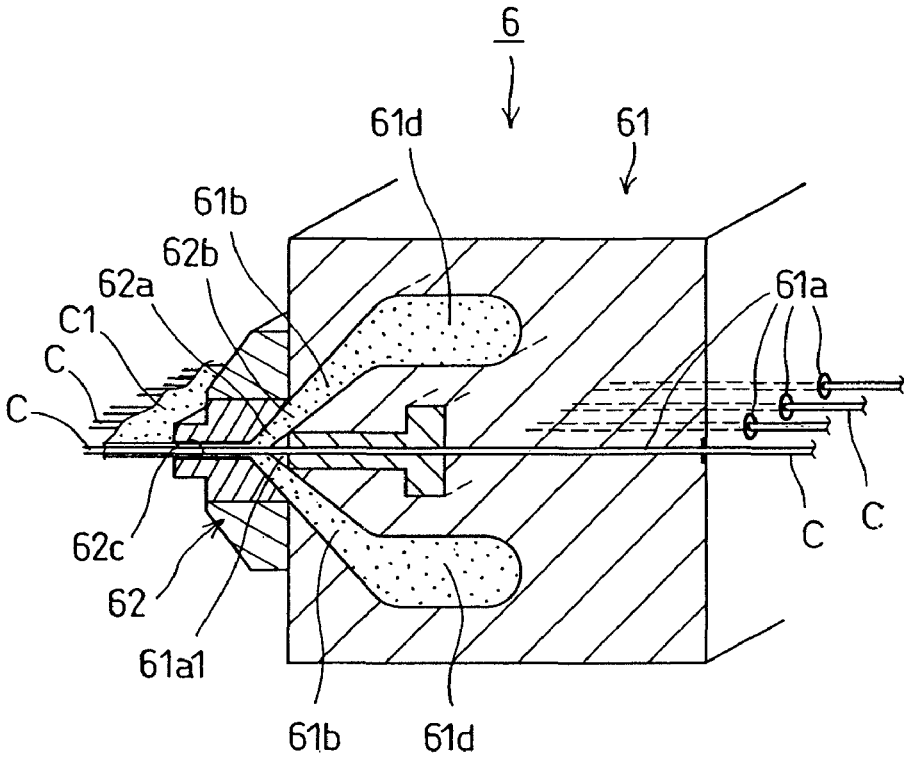
FIG. 7 is a partly sectional perspective view of an insulation head to be used in combination with the cord drying apparatus in the preferred embodiment.

The bands of the rayon cords C pressed against the curved heating surfaces 51*a*, 52*a* and 53*a* of the three heating boards 51, 52 and 53 are supplied to the insulation head 6 shown in FIG. 7. As shown, the insulation head 6 has a head body 61 provided with a plurality of small pores 61*a* extending through the head body 61. All the rayon cords supplied to the insulation head 6 are passed individually through the small pores 61*a*, respectively.

The small pores 61*a* are arranged at equal intervals in a single plane substantially perpendicular to the drawing sheet so as to extend across the head body 61 in a horizontal direction as viewed in FIG. 7. Each of extrusion caps 62 shown in FIG. 7 is provided with a slot 62*a* having a V-shaped cross section and openings 62*b*. Each extrusion cap 62 is attached to a side surface, in which the outlets 61*a*1 of the small pores 61*a* open, of the head body 61 such that the openings 62*a* thereof are connected to rubber passages 61*b* formed in the head body 61.

The extrusion caps 62 each provided with the slot 62*a* having the V-shaped cross section and extending in a direction perpendicular to the drawing sheet and capable of receiving the plurality of rayon cords C emerging through the outlets 61*a*1 of the small pores 61*a* are arranged continuously on the side surface of the head body 61 in which the outlets 61*a*1 of the small pores 61*a* open in a plane substantially perpendicular to the drawing sheet. The rubber passages 61*b* are connected to rubber accumulating cavities 61*d* into which heated, molten rubber is supplied. The rubber passages 61*b* are connected to the openings 62*b* of the V-shaped slots 62*a* of the extrusion caps 62.

The hot, molten rubber is extruded through the upper and the lower rubber passages 61*b* of the plurality of extrusion caps 62 onto the upper and the lower surfaces of the divisional bands of groups of the parallel rayon cords C arranged in a plane extending perpendicularly to the drawing sheet across the V-shaped slots 62*a* of the plurality of extrusion caps 62 to coat the groups of the rayon cords with the heated, molten rubber.

Cord-inserted rubber bands C1 (FIG. 8) formed by coating the groups of the parallel rayon cords C are delivered through exit slots 62*c* of the plurality of extrusion caps 62*a*. The exit slots 62*c* have a length equal to that of the V-shaped slots 62*a*. As shown in FIG. 3, the cord-inserted rubber band forming system is provided with five take-up units 7 to take up the plurality of cord-inserted rubber bands C1.

The cord drying apparatus having the above described configuration dries rayon cords C by the drying process including the following steps.

First, rayon cords C are drawn into the cord drying apparatus and are arranged parallel to each other as shown in FIG. 1. The rayon cords C pulled out from the plurality of reels 1*a* storing the rayon cords C and held in the wheeled creel 1 are passed individually through the small guide holes 21*a* of the main guide plate 21. The rayon cords C passed through the main guide plate 21 are arranged parallel to each other at substantially equal intervals in bands by the parallelizing guide rollers 22.

All the rayon cords C arranged in the bands are guided directly to the insulation head 6 in a plane between the arrangement of the three lower guide rollers 31, 32 and 33 and the arrangement of the two vertically movable rollers 41 and 42, namely, the upper guide rollers of a diameter greater than that of the lower guide rollers 31, 32 and 33. All the rayon cords C delivered to the insulation head 6 are passed through the small pores 61*a* extending through the head body 61 and are divided into groups. The leading ends of the rayon cords C in the groups are connected to the winding members of the take-up units 7 as shown in FIG. 3.

The condition of the heating boards 51, 52 and 53 are examined typically after the rayon cords C have been thus passed through the cord-inserted rubber band forming system or at a proper time. If the heating surfaces of the heating boards 51, 52 and 53 are heated a temperature necessary for drying the rayon cords C and the rubber supplied to the insulation head 6 is in a desired molten state, the two vertically movable rollers 41 and 42 held at a position corresponding to the upper parts of the guide grooves A1 of the guide parts A2 are released. Then, the vertically movable rollers 41 and 42 are allowed to move down along the guide grooves A1 by sending out the rayon cords C from the wheeled creel 1.

The vertically movable roller 41 moves down through the spaces between the lower guide rollers 31 and 32 and between the heating boards 51 and 52. The vertically movable roller 42 also moves down through the spaces between the lower guide rollers 32 and 33 and between the heating boards 52 and 53. As the two vertically movable rollers 41 and 42 move down, the bands of the parallel rayon cords C are pulled down so as to be wound round the lower guide rollers 31, 32 and 33 and the vertically movable rollers 41 and 42 in a zigzag shape as shown in FIG. 2. Thus the bands of the rayon cords C are pulled down smoothly through a space between the respective heating surfaces 51*a* and 52*a* of the heating boards 51 and 52, and a space between the respective heating surfaces 52*a* and 53*a* of the heating boards 52 and 53.

Upon the arrival of the vertically movable rollers 41 and 42 at positions below the lower ends of the heating boards 51, 52 and 53, that is, upon the arrival of lower parts of the bands of the rayon cords C pulled down by the vertically movable rollers 41 and 42 at positions below the lower end of the heating boards 51, 52 and 53, an operation for sending out the rayon cords C from the wheeled creel 1 is stopped and the sliding blocks are locked in place in the guide grooves A1, while the rollers 41 and 42 are allowed to be rotatable.

Then, the two heating boards 51 and 53 are moved toward the middle drying board 52. Consequently, the rayon cords C guided by the lower guide rollers 31, 32 and 33 are pressed against the respective curved heating surfaces 51*a*, 52*a* and 53*a* of the heating boards 51, 52 and 53 to complete the preparation for the drying process (see FIG. 2).

After the completion of the preparation, the take-up units 7 (FIGS. 2 and 3) are actuated to drive the winding members for rotation to start taking up the rayon cords C. The take-up operation of the take-up units 7 pulls out the rayon cords C continuously from the reels 1*a* held in the wheeled creel 1. The rayon cords C run through the guide holes 21*a* of the main guide plate 21 and pass the parallelizing guide rollers 22. Thus the rayon cords C are arranged parallel to each other at equal intervals in a plane in bands. The rayon cords C are guided downward by the right lower guide roller 33 so as to run downward along the curved heating surface 53*a* of the right heating board 53.

The parallel rayon cords C arranged in the bands are guided upward by the right vertically movable roller 42 held at the position below the lower end of the right heating board 53 so as to be pressed against and to run upward along the right curved heating surface 52*a* of the middle heating board 52. Then the parallel rayon cords C are guided downward by the middle lower guide roller 32 so as to run downward along the left curved heating surface 52*a* of the middle heating board 52. Then the parallel rayon cords C are guided upward by the left vertically movable roller 41 so as to be pressed against and to run upward along the curved heating surface 51*a* of the left heating board 51. During this process, the highly hygroscopic rayon cords C are dried so as to have a desired moisture content.

The left lower guide roller 31 guides the bands of the dried rayon cords C so as to run horizontally toward the insulation head 6. The width of each of the bands of the rayon cords C is about 80 mm.

Figure 8:
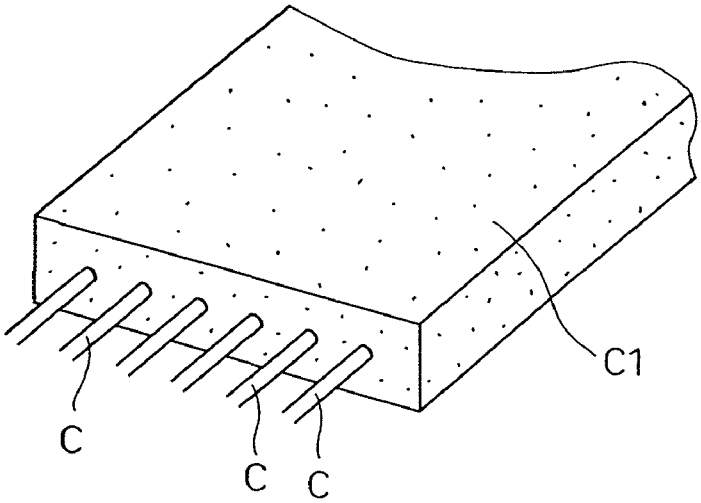
FIG. 8 is a fragmentary perspective view of a cord-inserted rubber band formed by coating a plurality of parallel cords with rubber.
Figure 9:
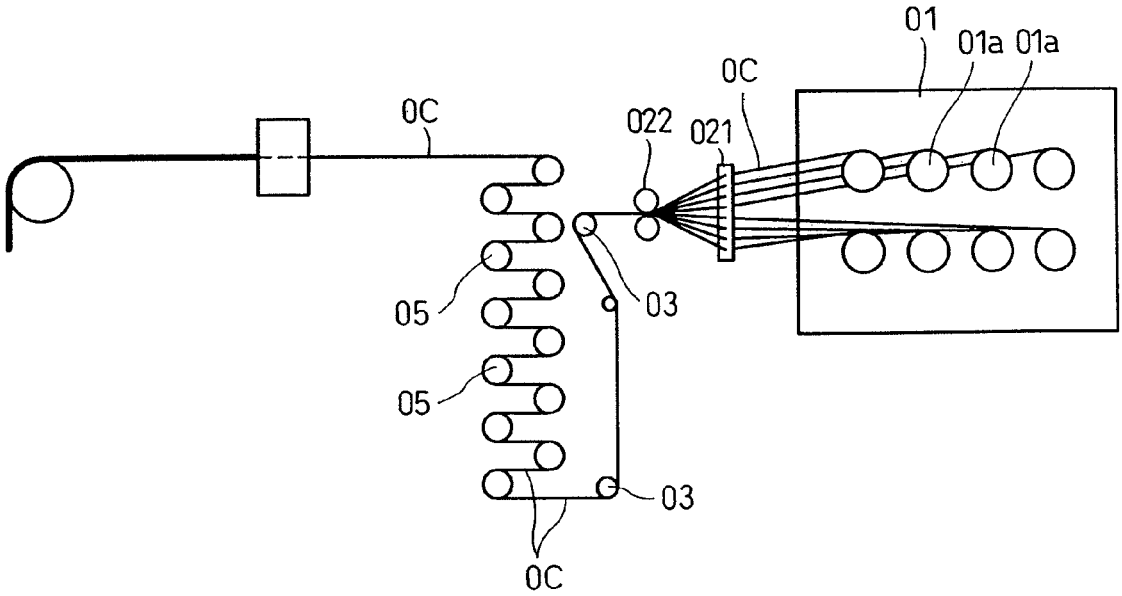
FIG. 9 is schematic side elevation of a cord-inserted rubber band forming system including a conventional cord drying apparatus.

The rayon cords C are passed individually through the small pores 61*a* arranged in a plane in the head body 61. The rayon cords C arranged in a plane and emerging through the exit of the small pores 61*a* are divided into groups in the extrusion caps 62 of the insulation head 6. The cord-inserted rubber bands C1 are formed by extruding the molten rubber through the rubber passages 61*b* onto the upper and the lower surfaces of the groups of the rayon cords C so as to coat the groups of the rayon cords C. The cord-inserted rubber bands C1 are delivered through the exit slots 62*c* of the extrusion caps 62. Each of the cord-inserted rubber bands has the plurality of rayon cords C arranged at equal intervals, and a rubber band as a coating on the rayon cords C (FIG. 8).

The cord drying apparatus of the present invention of the foregoing construction exercises the following operations and effects.

Since the heating boards 5 of the cord drying apparatus of the present invention are electric heating boards, the heating surfaces of the heating boards 5 can be heated at 105° C. necessary for drying rayon cords C in a very short time of about 1 min, whereas time needed to heat the surface of the hot-water-heated drying drum employed in the conventional drying apparatus at a working temperature is about 2 hr.

The rayon cords C extended in flat bands can be brought into contact with the heating surfaces of the heating boards 5 by moving down the vertically movable rollers 41 and 42. Thus the rayon cords C can be easily extended along a cord drying path for the drying process in a very short time. Consequently, the empty wheeled creel 1 can be replaced with a full wheeled creel 1 in about 10 min, which is very short as compared with about 2 hr needed to replace an empty wheeled creel with a full wheeled creel when a drying apparatus provided with hot-water-heated drums is used.

When a cord breaks, the broken cord is not pulled out from the reel because the heating boards 5 do not rotate like the conventional drying drums. Therefore, the broken cord will not be entangled and hence repairing work for piecing together broken ends of the broken cord can be accomplished in a short time. Since the broken cord is not entangled, the broken cord can be repaired in about 5 min.

The invention claimed is:

1. A cord drying method used in a process of processing cords for forming a component member of a tire by passing cords pulled out from a wheeled creel through a guide plate to extend the cords parallel to each other, delivering the parallel cords to an insulation head, and processing the parallel cords by a covering process by the insulation head to coat the parallel cords with rubber, said cord drying method comprising the steps of:

lowering upper rollers disposed above the parallel cords passed through the guide plate and extended directly to the insulation head;

pressing the parallel cords by the upper rollers so as to extend along heating surfaces of heating boards by lowering the upper rollers; and drying the cords by pressing the cords against the heating surfaces of the heating boards.

2. The cord drying method according to claim 1, wherein the cords are supported by lower rollers disposed under the cords when the cords are lowered along the heating surfaces of the heating boards by lowering the upper rollers.

3. The cord drying method according to claim 1, wherein the cords are those for forming a component member of a tire.

4. The cord drying method according to claim 1 or 2, wherein the cords are hygroscopic cords such as rayon or nylon cords.

5. A cord drying apparatus comprising:

a wheeled creel supporting a plurality of reels storing cords;

a guide plate for regularly arranging the cords unwound from the reels so as to extend parallel to each other and guiding the regularly arranged cords toward an insulation head;

guide rollers for guiding the cords;

heating boards disposed between the guide rollers and the insulation head and selectively used to dry the parallel cords or not to dry the parallel cords; and vertically movable rollers movable down from a position above the heating boards to a position below the heating boards to press the cords so as to extend along surfaces of the heating boards to dry the cords by a drying process.

6. The cord drying apparatus according to claim 5, wherein each of the heating boards has a heating plate having a substantially vertically extending curved heating surface, and is internally provided with a heater.

7. The cord drying apparatus according to claim 5 or 6, wherein the heating boards comprises a stationary middle heating board, and movable heating boards disposed on the opposite sides, respectively, of the middle heating board.

8. The cord drying apparatus according to claim 5 further comprising lower guide rollers supporting from below the parallel cords thereon and arranged between the guide plate and the insulation head, wherein each of the vertically movable rollers is moved down along a space between adjacent ones of the lower guide rollers.

* * * * *